United States Patent [19]

Spilker

[11] 4,056,207

[45] Nov. 1, 1977

[54] DIE CHANGER

[76] Inventor: James W. Spilker, R.R. 2, Box 195, New Palestine, Ind. 46163

[21] Appl. No.: 705,666

[22] Filed: July 15, 1976

[51] Int. Cl.[2] ..... B66F 9/18

[52] U.S. Cl. ..... 214/652; 187/11; 214/1 QA

[58] Field of Search ..... 214/1 D, 1 R, 1 H, 1 QA, 214/1 Q, 650 R, 651, 652, 653, 654, 655, 95 R, 331, 333, 620; 294/106; 187/9 R, 11

[56] References Cited

U.S. PATENT DOCUMENTS

| | | | |
|---|---|---|---|
| 1,964,119 | 6/1934 | Hendry | 214/653 X |
| 2,730,257 | 1/1956 | Stresau, Jr. | 214/650 R |
| 2,848,128 | 8/1958 | Thompson | 214/653 |
| 2,905,347 | 9/1959 | Hopfeld | 214/654 |
| 3,738,519 | 6/1973 | Edwards | 214/652 |

*Primary Examiner*—Frank E. Werner

[57] ABSTRACT

This device consists primarily of a portable frame, having a manually operated winch, which will elevate formed die clamps.

3 Claims, 4 Drawing Figures

FIG. 1
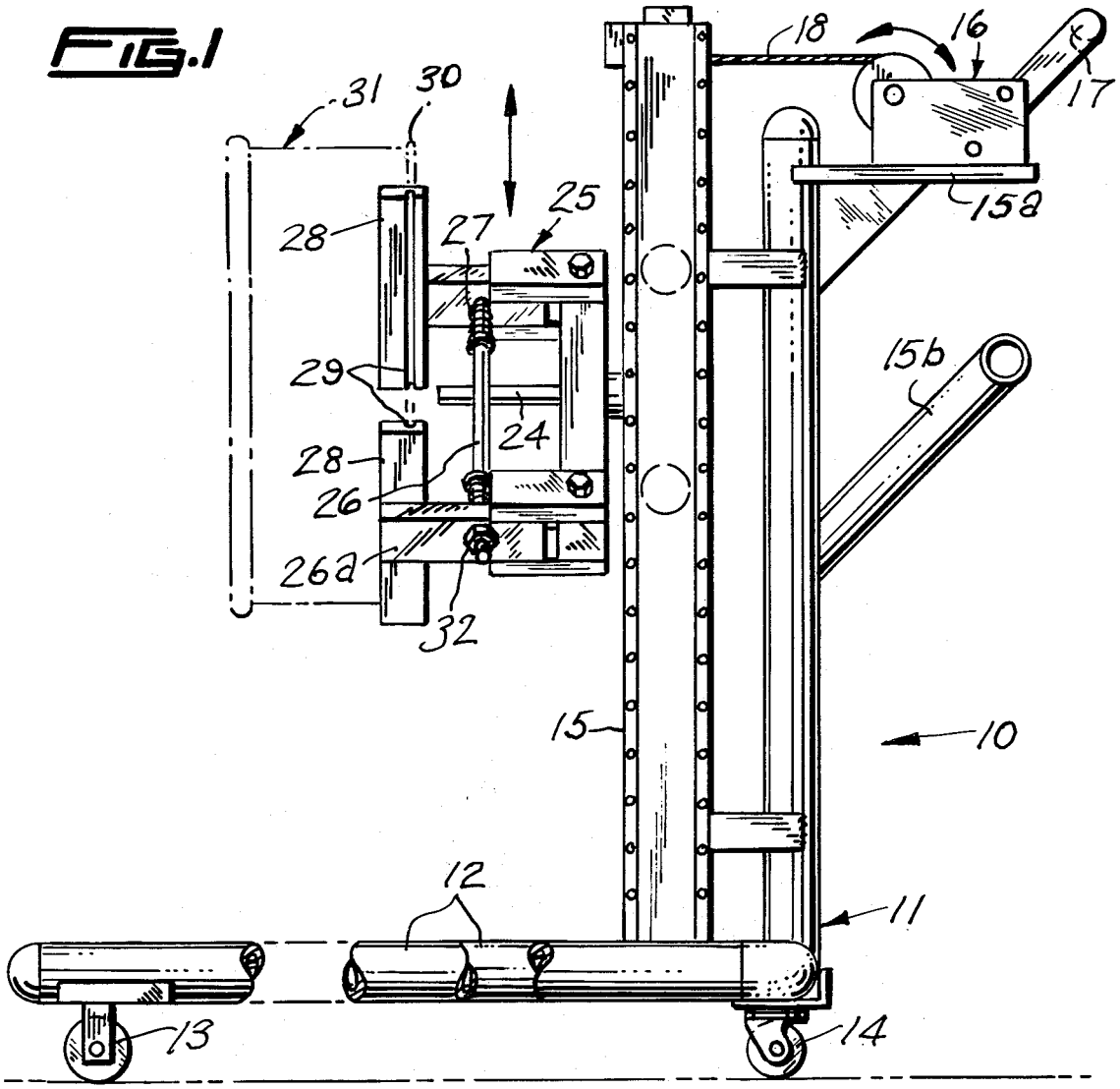
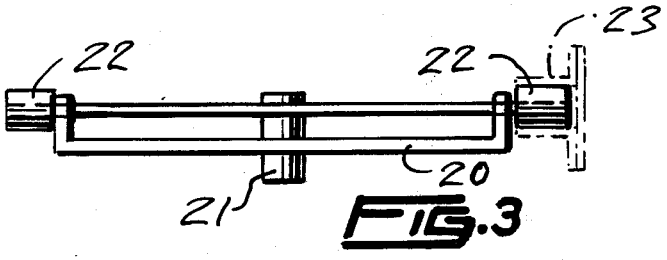
FIG. 3
FIG. 4
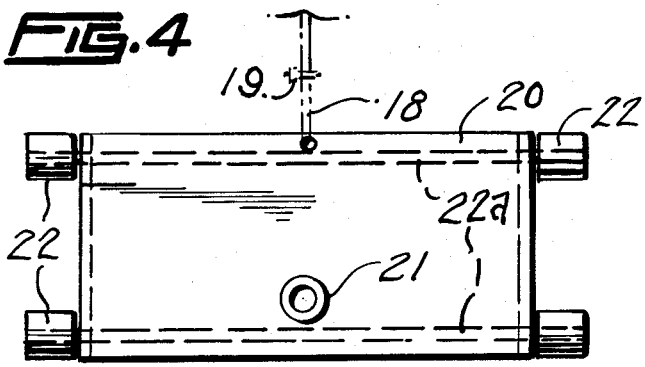
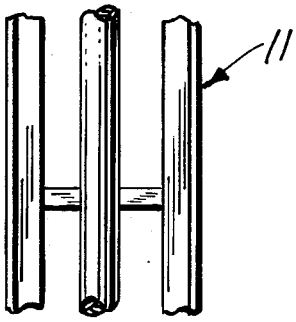
FIG. 2

DIE CHANGER

This invention relates to hoists, and more particularly to a die changing device.

It is, therefore, the principal object of this invention to provide a die changing device, which will enable one person to pick up, transport, and install pellet forming dies, which weigh as much as six hundred pounds.

Another object of this invention is to provide a device of the type described, which will be unique, because it can lift the above mentioned dies, from the floor.

A further object of this invention is to provide a device of the type described, which will elevate the die, to working height, and it will support the die until it is secured to the feed mill.

Other objects of this invention are to provide a die changing device, which is simple in design, inexpensive to manufacture, rugged in construction, easy to use and efficient in operation.

These and other objects will be readily evident upon a study of the following specification and the accompanying drawing, wherein:

FIG. 1 is a side view of a die changing device, comprising the present invention, the view showing a die in phantom lines;

FIG. 2 is a fragmentary front view of FIG. 1, shown in elevation and on a smaller scale;

FIG. 3 is a top plan view of the clamp support plate, shown removed from the invention, the view illustrating one of the guide rails in phantom lines; and FIG. 4 is a front view of FIG. 3, shown in elevation with the wire rope shown in phantom lines.

According to this invention, a die changing device 10 is shown to include a frame 11, having spaced apart and parallel legs 12. On the forward portions of legs 12 are secured non-swiveling casters, and on the rear portions of legs 12 are secured swiveling casters 14, which provide steering means for frame 11. Secured, fixedly, to frame 11, are a pair of parallel spaced apart posts 15, for a purpose which, hereinafter, will be described. Secured to frame 11, fixedly, is a plate **15*a*, to which is secured a winch 16, having a handle 17 for the operation thereof. Winch 16 is spaced above handle 15*b*, which is fixedly secured to frame 11, the handle 15*b* enabling the user to guide device 10. Wire rope 18, of winch 16, is secured by clamp 19 means, to the upper portion of support clamp plate 20. Clamp plate 20 is provided with a sleeve 21, which is secured fixedly therein, and a pair of rollers 22 are secured on shafts 22*a*, which extends to the sides of plate 20. Rollers 22 are freely received within the spaced apart and parallel channels 23, which are fixedly secured within posts 15 of frame 11**.

It shall be noted that the wire rope 18, of winch 16, is carried upon upper pulley means secured within the upper portion of the posts 15, the pulley means being not shown.

A shaft 24 is received within sleeve 21, and shaft 24 extends through the die lifting fixture 25. A shaft 26 extends through arms **26*a* of lifting fixture 25, and a coil spring 27, one on each side, of shaft 26, are for clamp retraction. Secured to the ends of arms 26*a* are fingers 28 having each, a groove 29 for removably receiving the rim of a die 31**.

In use, the operator by means of handle **15*b*, pushes device 10 into place. He then lowers the die lifting fixture 25 by means of the winch 16. The operator is then able to secure the die 31 by aligning the die 31 with the die clamp fingers 28. The operator then tightens the clamp nut fastener 32, after which the operator then raises the die 31** off the floor.

When the device 10 is positioned in front of the pellet mill, the lifting fixture 25 can be lifted to working height, by means of the manually operated winch 16.

It shall be noted that the lifting fixture 25 may be rotated three hundred and sixty degrees on shaft 24, so as to align the drive key-way on the forming die 31.

While various changes may be made in the detail construction, it shall be noted that such changes will be within the spirit and scope of the present invention as is defined by the appended claims.

What I claim is:

1. A die changing device, comprising, in combination, a frame, a pair of posts secured to said frame for supporting a pair of guide channels, a winch secured to said frame for raising and lowering support clamp plate, a die lifting fixture freely received upon shaft means extending from said support clamp plate, and die clamp finger means secured to said lifting fixture; said posts being parallel spaced apart and fixedly secured to parallel spaced apart and horizontal leg members of said frame, and said guide channels being parallel spaced apart and fixedly secured, one each in said posts, said guide channels freely receiving a pair of rollers secured to shaft means extending from the side edges of said support clamp plate, and said support clamp plate having a wire rope secured to it at its upper center, said wire rope extending from said winch and being carried upon upper pulley means secured within an upper portion of said posts, said winch being fixedly secured to said frame at its upper extremity.

2. The combination, according to claim 1, wherein a sleeve extends through said clamp plate, said sleeve receiving an end of a shaft rotatably received within one end of said die lifting fixture, said die lifting fixture having spaced apart arm means which freely receives a second shaft having spring means at each end, and nut fastener means for tightening said die clamp fingers.

3. The combination according to claim 2, wherein said die clamp fingers are fixedly secured at right angles to said arms of said die lifting fixture, and groove means on the inside faces of said die clamp fingers, removably receive the outer peripheral rim of a die.

* * * * *